US006805622B1

(12) United States Patent
Dorner

(10) Patent No.: US 6,805,622 B1
(45) Date of Patent: Oct. 19, 2004

(54) SKI SHARPENING ARRANGEMENT

(76) Inventor: Wolfgang C. Dorner, 5166 N. Hwy. 83, Chenequa, WI (US) 53029

( * ) Notice: Subject to any disclaimer, the term of this patent is extended or adjusted under 35 U.S.C. 154(b) by 0 days.

(21) Appl. No.: 10/386,037

(22) Filed: Mar. 11, 2003

(51) Int. Cl.[7] ..... B24B 23/00

(52) U.S. Cl. ..... 451/358; 451/344; 451/349; 451/355; 451/360; 451/364

(58) Field of Search ..... 451/358, 344, 451/349, 355, 360, 364–371

(56) References Cited

U.S. PATENT DOCUMENTS

| | | | | |
|---|---|---|---|---|
| 3,512,308 A | | 5/1970 | Schell, Jr. | |
| 3,585,760 A | * | 6/1971 | Richmond | 451/355 |
| 3,643,385 A | * | 2/1972 | Mikiya | 451/355 |
| 3,837,123 A | * | 9/1974 | Bradbury | 451/545 |
| 3,875,825 A | | 4/1975 | Buttafuoco | |
| 4,280,378 A | | 7/1981 | Levine | |
| 4,509,297 A | | 4/1985 | Lindgren | |
| 4,882,953 A | | 11/1989 | Kalka | |
| D319,568 S | | 9/1991 | Sherman | |
| 5,136,816 A | | 8/1992 | Beckingham | |
| 5,597,344 A | * | 1/1997 | Bocquet | 451/65 |
| 6,086,465 A | * | 7/2000 | Mayr | 451/293 |

* cited by examiner

*Primary Examiner*—Joseph J. Hail, III
(74) *Attorney, Agent, or Firm*—Andrus, Sceales, Starke & Sawall, LLP

(57) ABSTRACT

A ski sharpening arrangement includes a portable powered grinder adapted to be manipulated by one hand of a user. The arrangement includes a motor assembly spaced from a ski having a top surface, a base, a side edge and a bottom edge coplanar with the base. The motor assembly drives an endless belt having an abrasive surface about an axis of rotation transverse to a plane of the base. The endless belt is entrained about a mounting framework extending from the motor assembly, and engaged against the side edge of the ski to provide sharpening thereof. A support structure is suspended from the mounting framework of the belt and is adapted to be manipulated by another hand of the user for guiding, stabilizing and changing the angle of the abrasive surface relative to the side edge of the ski.

17 Claims, 4 Drawing Sheets

SKI SHARPENING ARRANGEMENT

FIELD OF THE INVENTION

The present invention relates broadly to apparatus for grinding and finishing the metal edge of a workpiece and, more particularly, pertains to a modified, portable, power tool for sharpening the side edges of a ski.

BACKGROUND OF THE INVENTION

It is common practice today to provide a biting edge to snow skis and snowboards by use of a metal strip along each side at the bottom corners. Each strip is flush with the base of the ski, but extends slightly out from the sides of the ski. This edge provides a surface to cut into the snow, and adds to the maneuverability. For a ski or snowboard to carve an arc on hard or icy snow surfaces without sliding, it is necessary to have as sharp an edge as possible.

With use, these edge surfaces often become dented or otherwise dulled and it becomes necessary to sharpen them. Presently, machines and tools are available to flat finish the base of the ski, but it becomes much more difficult to accomplish proper sharpening along the sides of the ski. Often, the sharpening is done by skilled personnel carrying out ski sharpening services in association with the sale of skis and related equipment. To maintain the sharp edge surfaces, the sides of the ski or snowboard are normally hand-filed, which is a slow process and requires experience to perform the task with a high level of skill.

An owner may manually sharpen his/her own skis if a suitable tool is available for doing so. A known tool is designed with a short metal file set in an L-shaped holder provided with an angle plate for changing the sharpening angle of the file. The user moves the holder along the ski edge with the file contacting the side edge while a guide plate slides along the base of the ski. Other types of hand held or hand operated ski sharpening tools are available but all are generally extremely labor intensive to use and do not produce acceptable results.

Electrically operated ski sharpeners are also known in which a grinding wheel or disc is driven by an electric motor which is manually slid along the base of the ski. Although guide devices are included in these designs, the vibration and lack of proper stabilization of the motor tends to affect the quality and uniformity of the ski sharpening. In at least one of these motorized ski sharpeners, a device is included to change the disposition of the ski so as to vary the sharpening angle or "backcut" on the side edges. However, it appears that the maintaining of this angle is not always satisfactory.

In addition to the need to sharpen the side edge of a ski or snowboard that has become dented or dulled, many ski and snowboard racers change the backcut angle of their side edges depending upon the snow/ice conditions of the race course. The backcut may vary from a 2° angle to as much as 7°, depending upon the conditions. A backcut with a greater angle, such as 2°–7°, will become dull at an increasingly fast rate. Thus, if a racer wishes to maintain the proper backcut angle, the side edges must be sharpened at a much greater frequency.

It would be desirable to provide an improved ski sharpening arrangement which alleviates the drawbacks of manually and motor operated ski sharpeners such that a consistent, accurate and efficient grinding of the side edges of the ski are easily obtainable and lead to optimized stability and performance for the skier. It is desirable to provide a ski sharpening arrangement mainly intended for a serious racer and ski technician such that the racer or technician can sharpen a ski prior to a race. It is desirable to provide an improved ski sharpening arrangement that includes inexpensive and replaceable grinding surfaces which are easy to replace and exchange.

SUMMARY OF THE INVENTION

It is a general object of the present invention to provide an arrangement for guiding, stabilizing and changing the angle of a movable abrasive surface on a powered belt grinder for sharpening the side edge of a ski.

It is also an object of the present invention to provide a ski sharpening arrangement for protecting the base of the ski during sharpening of a ski side edge.

It is a further object of the present invention to provide a portable, powered belt grinder modified with a support structure which is particularly applicable for on-site sharpening of skis by an owner thereof.

It is an additional object of the present invention to provide a ski sharpener having a motor which is held spaced from the ski during operation to avoid problems caused by excess vibration.

It is another object of the present invention to provide a ski sharpening arrangement which will provide and maintain accurate backcutting in. the sharpening of a ski side edge and the plastic bonding and support of the metal edge.

In one aspect of the invention, the ski sharpening arrangement includes a portable, powered grinder adapted to be manipulated by one hand of a user and including a motor assembly spaced from a ski having a top surface, a base, a side edge and a bottom edge coplanar with the base. The motor assembly drives an endless belt having an abrasive surface about an axis of rotation transverse to a plane of the base. The endless belt is entrained about a mounting framework extending from the motor assembly and is engaged against the side edge of the ski to provide sharpening thereof. A support structure is suspended from the mounting framework of the belt and is adapted to be manipulated by another hand of the user for guiding, stabilizing and changing the angle of the abrasive surface relative to the side edge of the ski.

In a preferred embodiment, the mounting framework includes a channcl-shaped member having an upper wall, a lower wall and a connecting wall joining the upper and lower walls. The lower wall has a belly portion for guiding the abrasive surface of the belt into an area of contact with the side edge of the ski. The connecting wall defines a mounting surface for attaching the support structure to the powered grinder. The support structure includes a roller assembly coupled with a movable adjustment device having a pair of sidewalls, a front wall joining the sidewalls and the top wall connecting the sidewalls and the front wall. The roller assembly includes a generally U-shaped holder having a first leg and a second leg joined to a bight portion. The roller assembly further includes a guide roller rotatably mounted on the holder for movement against and along the base of the ski. The guide roller has an outer peripheral surface formed with a series of annular grooves for holding a plurality of 0-rings therein. The guide roller has an internal wall defining a passageway for receiving a shaft held fixed relative to the holder. A set of bearings is positioned between the internal wall of the guide roller and the shaft so that the guide roller rotates relative to the fixed shaft. A stabilizing handle adapted to be manipulated by another hand of the user is secured to the bight portion of the holder. The shaft has one end which projects into a fixed sleeve having one extending beyond the top wall of the adjustment device. The one end of the sleeve is provided with an indicator plate. One of the sidewalls is secured to the connecting wall of the mounting framework. An L-shaped reinforcing bracket is placed between the one sidewall and the connecting wall. The front wall of the adjustment device is formed with a lower circular opening, an upper slotted opening and a pointed indicator. A lower fastener is passed through the lower circular opening and partially threaded into the sleeve. An upper fastener is passed through the upper slotted opening and threaded into the sleeve. With this construction, selected manipulation of the upper and lower fasteners enables a tilting of the adjustment device relative to the sleeve, and causes an angular adjustment of the abrasive surface of the belt relative to the side edge of the ski. The adjustment device is located adjacent the mounting framework of the powered grinder and above the side edge of the ski. The O-rings on the guide roller are maintained against the base of the ski by applying a force on the handle in a direction transverse to a rotational axis of the guide roller. An indicator on the front wall of the adjustment device is movable relative to the indicator plate on the sleeve when the adjustment device is tilted relative to the sleeve.

Various other objects, features and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
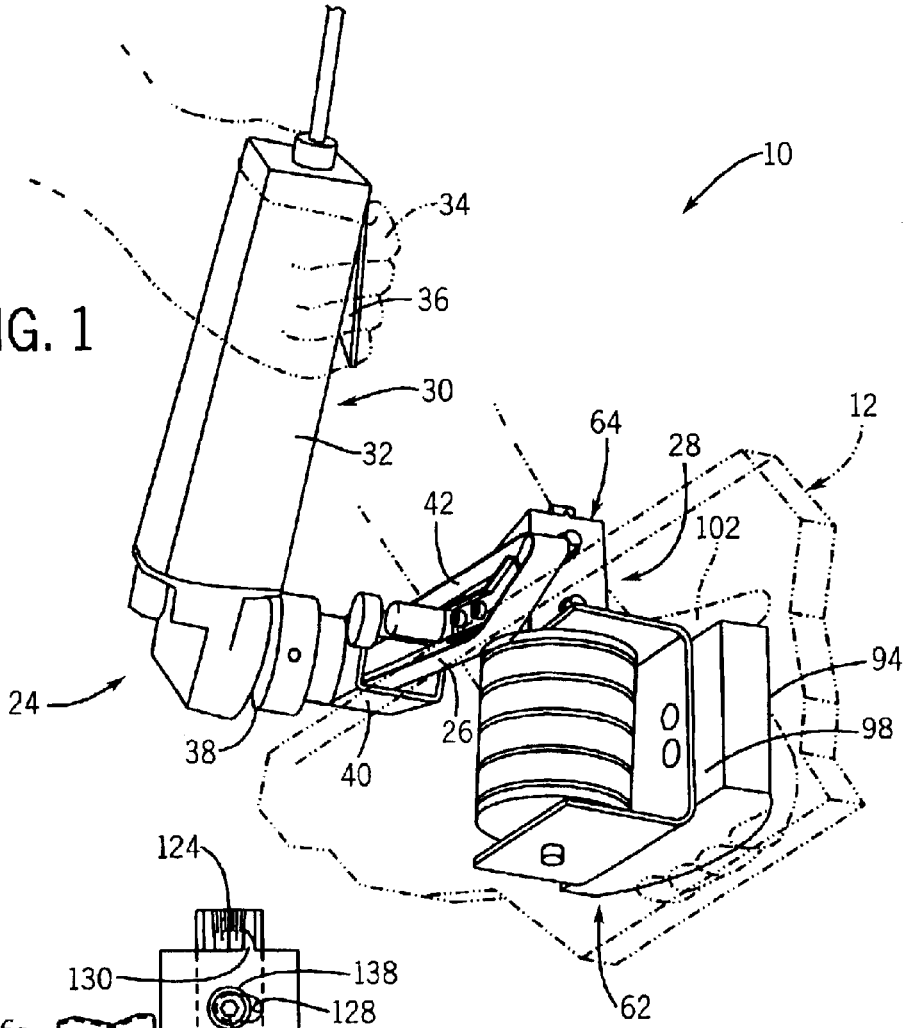
FIG. 1 is a perspective view of a ski sharpening arrangements for sharpening a side edge of a ski in accordance with the present invention.
Figure 2:
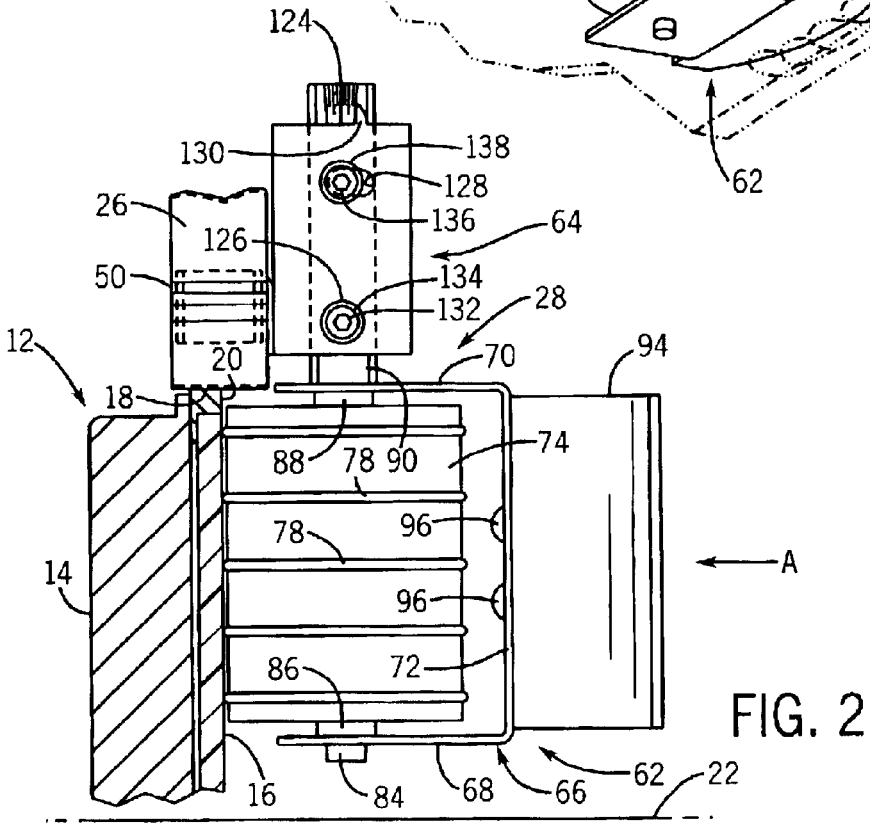
FIG. 2 is an enlarged, fragmentary view of the ski sharpening arrangement taken from the right hand end of FIG. I and showing an abrasive belt engageable with the side edge of the ski.
Figure 3:
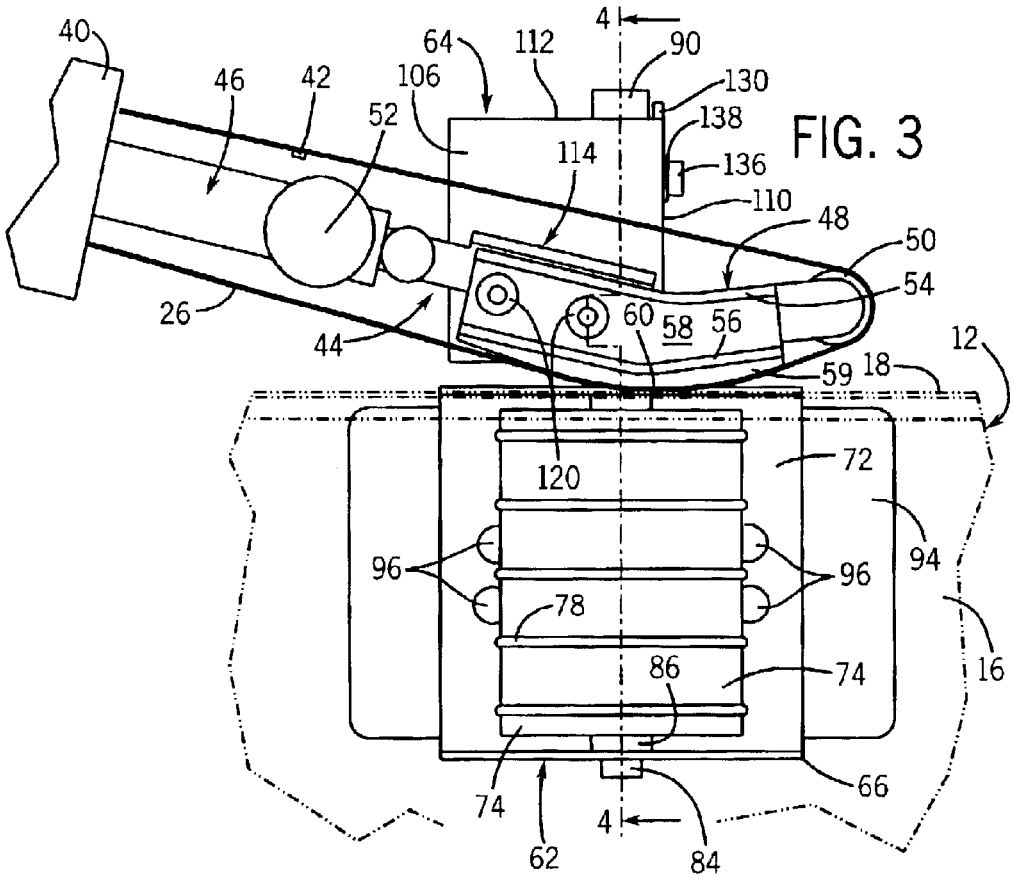
FIG. 3 is an enlarged, fragmentary, front view of the ski sharpening arrangement in FIG. 1.

Referring now the drawings and, in particular FIGS. 1–3, thereshown is a sharpening arrangement 10 for a ski 12 having a top surface 14, a base 16, a metal side edge 18 and a metal bottom edge 20 coplanar with the base 16. In the preferred embodiment, the ski 12 is shown fixed in a vertical orientation with the planes of the top surface 14, the base 16 and the bottom edge 20 disposed generally perpendicularly to a flat ground surface 22 (FIG. 2), and the plane of the side edge 18 lying substantially parallel to the ground surface 22. The ski sharpening arrangement 10 is comprised of an electrically powered, belt driven grinder 24 which is provided with a driven abrasive surface 26. The grinder 24 is coupled to a support structure 28 for grinding, stabilizing and changing the angle of the abrasive surface 26 relative to the side edge 18 of the ski 12.

The power grinder 24 is a commercially available, portable, abrasive belt machine manufactured and distributed by Dynabrade, Inc. of Clarence, N.Y. Such machine is more particularly identified as Model 40500 and is sold under the trademark Electric Dynafile® II, although other grinders are contemplated as being within the scope of the present invention. The grinder 24 is generally designed to be used in a variety of grinding, deburring, polishing, and finishing applications.

As seen in FIG. 1, grinder 24 preferably includes an electric motor assembly 30 having a housing 32 which may be gripped by one hand 34 of an operator for manipulation of the machine. The motor inside the housing 32 may have any suitable shut-off or speed control such as that afforded by a pivotally supported lever 36 which is adapted to be engaged by the hand 34 of the operator during use. It should be understood that the invention to be described below could also be driven by a battery powered motor, or a pneumatically-operated motor fed by a source of pressurized gas or air.

The electric motor assembly 30 provides a driving force through an angle head 38 disposed at a generally 90 degree relationship to the housing 32. At the lower end of the angle head 38 is an open ended casing 40 for holding a drive pulley (not shown) driven for rotation by the motor in housing 32. The drive pulley functions to drive an endless belt 42 having the abrasive surface 26 on an outer periphery thereof.

As shown in FIG. 3, a mounting framework 44 extends outwardly from the open end of the casing 40 and includes a tension bar 46 telescopically engaged with a contact arm 48 having a contact pulley 50 at an outer end thereof. A fastening knob 52 is screw threaded into mating ends of the tension bar 46 and the contact arm 48 to hold these components together. The endless belt 42 encircles the mounting framework 44 and is entrained about the drive pulley in the casing 40 and the contact pulley 50 on the contact arm 48 so that selective energization of the electrical motor assembly 30 will translate the abrasive surface 26 on the belt 42 against a side edge 18 of the ski 12. From FIG. 2, it can be appreciated that the axis of rotation of the contact pulley 50 is generally transverse to the plane of the ski base 16. As will be understood hereafter, this disposition makes it easier to visually observe the grinding action as abrasive surface 26 of the belt 42 is moved lengthwise along the side edge 18 of the ski 12.

Figure 4:
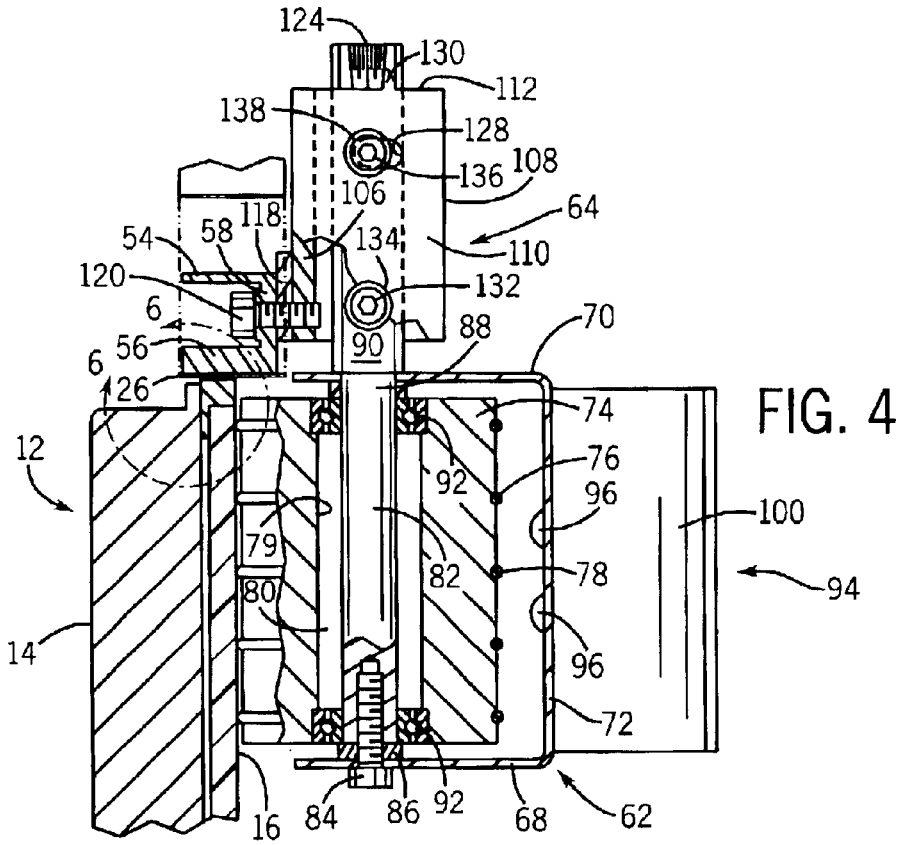
FIG. 4 is a cross sectional view taken on line 4—4 of FIG. 3.
Figure 5:
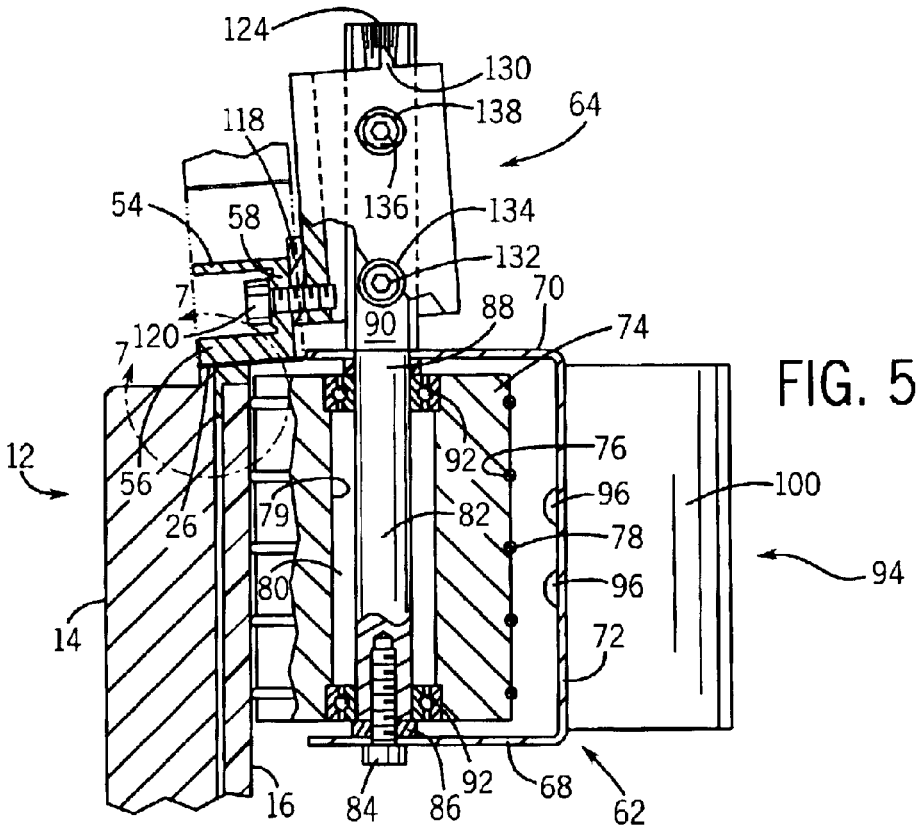
FIG. 5 is a view similar to FIG. 4, but showing an adjustment device for changing the angle of the abrasive belt relative to the side edge of the ski.

Referring now to FIGS. 3, 4 and 5, the contact arm 48 is a channel-shaped member having a reverse C-shaped cross section formed by an upper wall 54, a lower wall 56 and a connecting wall 58. The lower wall 56 includes a cushion member 59 having a curved contour or belly portion 60 for guiding the abrasive surface 26 of belt 42 into a defined area of contact with a side edge 18 of ski 12. An alternate configuration for guiding the abrasive surface 26 of the belt 42 will be described in detail below with reference to FIGS. 8 and 9. The connecting wall 58 is drilled with a pair of spaced apart openings to facilitate attachment of the support structure 28 as will be detailed below.

Support structure 28 is defined by a roller assembly 62 for guiding and stabilizing the grinder 24, and a tiltable adjustment device 64 for selectively changing the angle of the abrasive surface 26 relative to the side edge 18 of ski 12.

Roller assembly 62 includes a generally U-shaped holder 66 having a first leg 68 and a second leg 70 integrally joined to a bight portion 72. The holder 66 is designed to mount a guide roller 74 for movement against and along the base 16 of the ski 12 during sharpening of the side edge 18. The outer periphery of the roller 74 is provided with a series of spaced apart, annular grooves 76 for holding a plurality of O-rings 78 which protect the base 16 of ski 12 as roller 74 translates therealong. The O-rings 78 provide the additional function of creating a small gap between the outer periphery of the roller and the base 16 of ski 12 such that the metal and plastic filings created during sharpening can fall away and do not scratch the base of the ski.

Roller 74 is formed with an internal wall 79 defining a passageway 80 for accommodating an elongated shaft 82 which is fixed relative to the holder 66. A lower end of shaft 82 is drilled and tapped to receive a threaded portion of a screw 84 which is passed through an aperture in the first leg 68 of holder 66 and a spacer 86 disposed between a lower end of roller 74 and an inside surface of the first leg 68. An upper end of shaft 82 passes through a non-rotatable collar 88 positioned between an upper end of roller 74 and an outer surface of the second leg 70 of holder 66. The upper end of shaft 82 extends beyond the outer surface of the second leg 70 into a fixed sleeve 90 which is further attached to the adjustment device 64. A set of bearings 92 is installed between the outer diameter of the shaft 82 and the wall 79 defining the internal passageway 80 at upper and lower ends of the roller 74 so that the roller 74 will freely rotate on the fixed shaft 82.

Although a roller 74 is described in the preferred embodiment, it should be understood that other types of stabilizing members, such as a guide block, could be utilized while operating within the scope of the present invention. Such a guide block would have a non-friction surface such that it could slide along the base of the ski.

The bight portion 72 of holder 66 acts as a mounting surface for a vibration-absorbing, rubber handle 94 which is fixed to an outer surface of bight portion 72 by four screws 96 (FIG. 3) passed through suitable holes in bight portion 72 and threaded into a planar, back surface 98 (FIG. 1) of handle 94. The handle 94 extends beyond the ends of the bight portion 74 and has a saddle shaped, front surface 100 engageable with another hand 102 (FIG. 1) of the operator to apply a light force in the direction of arrow A (FIG. 2). Manual engagement of the handle 94 enables the roller 74 to be maintained in constant contact with the base 16 of the ski despite any vibrations generated during grinding of the side edge 18 to ensure a more consistent quality of grinding along the entire length thereof.

As best illustrated in FIGS. 3, 4, and 5, tiltable adjustment device 64 includes a pair of sidewalls 106, 108, a front wall 110 and a top wall 112. A spacer 118 is placed between connecting wall 58 of contact arm 48 and sidewall 106. A lower portion of sidewall 106 is formed with a pair of spaced apart, threaded throughholes which are aligned with openings in connecting wall 58 of contact arm 48 and a pair of apertures in the spacer 118. A pair of fasteners 120 is passed through the aligned openings and apertures, and threaded into the throughholes of sidewall 106 to connect the mounting framework 44 of grinder 24 to the tiltable adjustment device 64. An expanded diameter portion 90 of shaft 82 extends beyond the upper and lower edges of the adjustment device 64 and runs adjacent an inside surface of the front wall 110. Top end of shaft 90 has a flat surface onto which indicator lines 124 are formed. Front wall 110 is provided with a lower circular opening 126 (FIG. 2) and an upper slotted opening 128 (FIG. 2), both of which are aligned with lower and upper threaded holes formed transversely in the sleeve 90. Front wall 110 is further provided with a pointed indicator 130 in registration with the indicator plate 124. A lower fastener 132 is passed through a washer 134 and lower opening 126 and threaded partially into the lower threaded hole in the expanded portion 90 of shaft 82. This creates a pivot point about which the adjustment device 64 may tilt under certain conditions. An upper fastener 136 passes through another washer 138 and slotted opening 128, and is threaded into the upper threaded hole in expanded portion 90.

Figure 6:
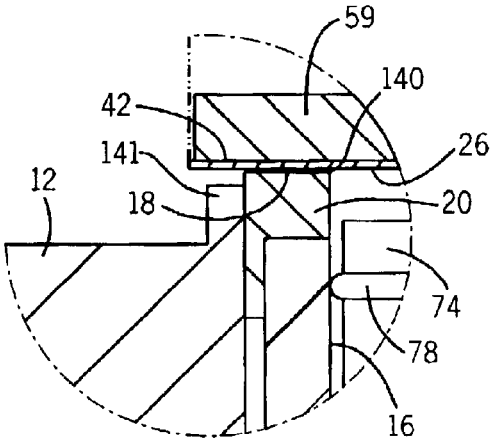
FIG. 6 is an enlarged, detail view taken on line 6—6 of FIG. 4.

In use, as seen in FIGS. 1 and 2, the motor assembly 30 is held spaced from the ski 12 by one hand 34 of the operator with the abrasive surface 26 of belt 42 resting flush on the entire surface of side edge 18. The other hand 102 of the operator is placed on the handle 94 so that the roller O-rings 78 will remain in constant protective guiding contact with the base 16 of the ski 12. Squeezing of the lever 36 on housing 32 will cause the belt 42 to move and begin grinding the side edge 18. With the fasteners 132, 136 threaded, as shown in FIGS. 4 and 6, the adjustment device 64 is upright such that abrasive surface 26 of belt 42 is at a zero degree setting enabling the abrasive surface 26 to grind the side edge 18 of ski along a substantially horizontal plane of contact.

Figure 7:
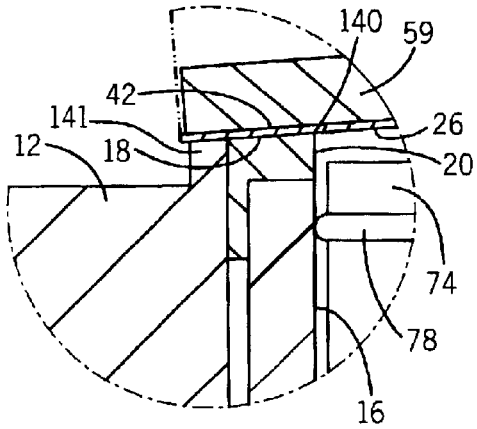
FIG. 7 is an enlarged, detail view taken on line 7—7 of FIG. 5.

As depicted in FIGS. 5 and 7, it has been found advantageous to "backcut" or change the angle of the abrasive surface 26 of the belt 42 over a range of several degrees so as to sharpen the running corner 140 (FIGS. 6 and 7) between the side edge 18 and the bottom edge 20. During this sharpening, the plastic support 141 is also removed at the backcut angle. In order to attain this effect, the upper fastener 136 and fastener 132 are loosened appropriately so as to allow slight tilting of the adjustment device 64 about the lower fastener 132 and changing of the angle of the abrasive surface 26 relative to side edge 18. The operator will refer to the alignment of the indicator 130 with the indicator plate 124 to determine the relative angle at which the abrasive surface 26 is set. After the adjustment device 64 is tilted to the desired angle, the upper fastener 136 and lower fastener 132 are retightened so that the abrasive surface 26 is stabilized throughout the grinding process. Stability is further enhanced by the force applied to the handle 94. After both side edges 18 and plastic supports 141 of the ski 12 are ground as desired, the bottom edges 16 of the ski 12 are finished in a separate but easy manner so as to debur or remove any excess material extending from the lower end of the side edges 18. If desired, the two fasteners 132, 136 and washers 134, 138 can be easily removed to separate the mounting framework 44 from the support structure 28. This enables the grinder 24 to be used for other grinding, deburring and finishing applications.

Figure 8:
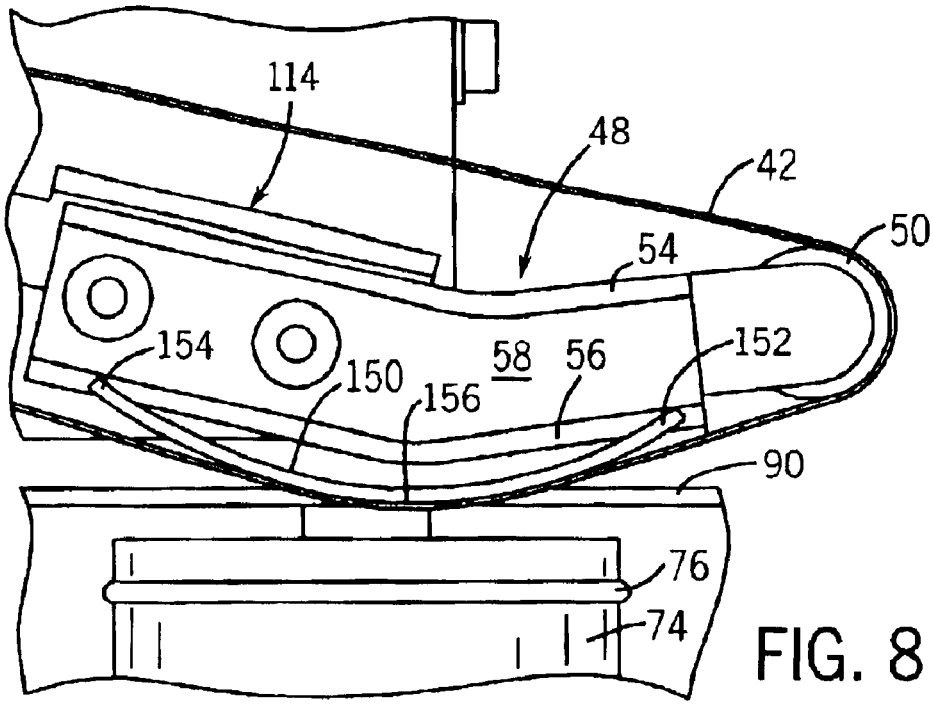
FIG. 8 is an enlarged, detail view of an alternate embodiment of the invention including a pre-stressed contact plate.
Figure 9:
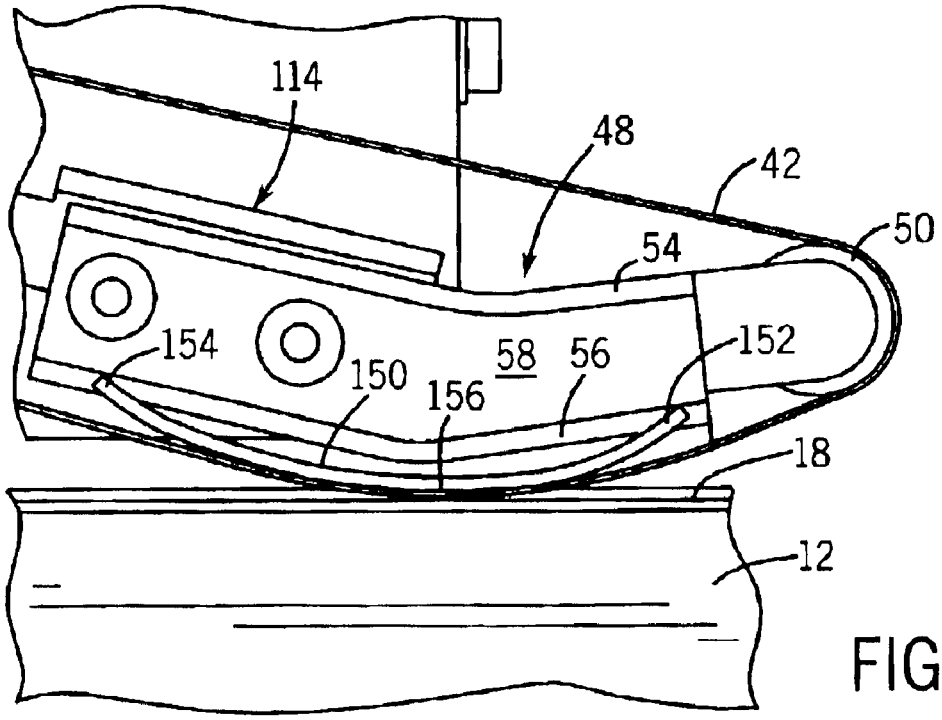
FIG. 9 is a view similar to FIG. 8 illustrating the contact plate in a flexed, sharpening condition.

Referring now to FIGS. 8 and 9, thereshown is an alternate embodiment for the contact arm 48. As illustrated in FIG. 8, a flexible contact member 150 is mounted to the lower wall 56 of the contact arm. The contact member 150 extends from a first end 152 to a second end 154. Both the first end 152 and the second end 154 are received within a formed notch in the lower wall 56. As illustrated in FIG. 8, the contact member 150 has a length greater than the distance between the formed notches in the lower wall 56 such that the contact member 150 flexes outward and into contact with the lower run of belt 42. In the preferred embodiment of the invention, the contact member 150 is a piece of tempered spring steel having a thickness of 0.015 inches. The spring steel used to form the contact member 150 allows the contact member 150 to bow outward and define a belly 156. The belly 156 contacts the lower run of the belt 42 as shown. In the embodiment of the invention illustrated, the contact member 150 is held in place by the spring force of the contact member 150 when the contact member is bent into the configuration shown in FIG. 8.

Referring now to FIG. 9, when the contact arm 48 is brought into contact with the side edge 18 of the ski 12, the contact member 150 flexes from the weight of the grinder to define a contact surface along a length of the side edge 18. In the embodiment of the invention illustrated in FIG. 9, the contact member has the same width as the belt 52. The spring steel contact member 150 shown in the preferred embodiment enhances the lateral stability of the contact between the belt 42 and the side edge 18 of the ski 12 to further enhance sharpening of the ski 12.

Although the contact member 150 is shown in FIGS. 8 and 9 as having ends 152 and 154 received in slots machined from the lower wall 56, it is contemplated by the inventor that other means of attachment could be used to secure the contact member 152 to the contact arm 48. Additionally, it is contemplated by the inventor that the contact member 150 could be formed from a flexible material other than spring steel while operating within the scope of the present invention.

It should now be appreciated that the present invention provides a ski sharpening arrangement 10 which conveniently modifies an existing abrasive belt machine 24 with a guiding and stabilizing support structure 28 for selectively changing the angle of an abrasive surface 26 used in grinding a side edge 18 of a vertically oriented ski 12. This arrangement 10 provides an increase in the quality and uniformity of sharpened side edges 18 of the ski 12 which is markedly more efficient than the labor intensive sharpening of the ski with a manual apparatus. The present invention overcomes drawbacks in other known powered sharpening arrangements wherein vibration of unstabilized, rotating grinding discs of units slid directly along a base of the ski can negatively affect a condition of the side edges. The present invention is believed to be particularly attractive for use on-site at a ski lodge where only a source of electrical power is required to quickly prepare one's skis for optimal control and speed.

Various alternatives and embodiments are contemplated as being within the scope of the following claims particularly pointing out and distinctly claiming the subject matter regarded as the invention.

I claim:

1. A side edge ski sharpening arrangement for sharpening a ski having a top surface, a base, a pair of side edges and a bottom edge coplanar with the base, comprising:

a portable, powered grinder adapted to be manipulated by one hand of the user and including a motor assembly for driving an endless belt having an abrasive surface defining a substantially flat plane of abrasion, the endless belt being entrained about a mounting framework extending from the motor assembly and rotatable about an axis generally perpendicular to the base of the ski, wherein the abrasive surface is engageable against the side edge of the ski to provide sharpening thereof; and a support structure suspended from the powered grinder and alignably positioned with the plane of abrasion to continuously contact the base of the ski along an entire length thereof to guide the abrasive surface relative to the side edge of the ski, wherein the support structure is adjustable to control the angle of the plane of abrasion relative to the base of the ski.

2. The ski sharpening arrangement of claim 1, wherein the mounting framework includes a channel-shaped member having an upper wall, a lower wall and a connecting wall joining the upper and lower walls.

3. The ski sharpening arrangement of claim 2, wherein the lower wall includes a flexible contact member for guiding the abrasive surface of the belt into an area of contact with the side edge of the ski.

4. The ski sharpening arrangement of claim 3, wherein the flexible contact member deflects upon contact with the side edge of the ski to increase the area of contact between the abrasive surface and the base of the ski.

5. The ski sharpening arrangement of claim 1, wherein the support structure includes a roller assembly coupled to a movable adjustment device, the movable adjustment device being mounted to the grinder.

6. The ski sharpening arrangement of claim 5, wherein the roller assembly includes a generally U-shaped holder having a first leg and a second leg joined to a bight portion.

7. The ski sharpening arrangement of claim 6, wherein the roller assembly further includes a guide roller rotatably mounted about a support shaft and adapted for movement against and along the base of the ski.

8. The ski sharpening arrangement of claim 7, wherein the guide roller has an outer peripheral surface formed with a series of annular grooves for holding a plurality of O-rings therein.

9. The ski sharpening arrangement of claim 6 further comprising a stabilizing handle secured to the bight portion of the holder, the stabilizing handle being adapted for manipulation by another hand of the user.

10. The ski sharpening arrangement of claim 7, wherein the support shaft has one end which projects beyond a top wall of the adjustment device.

11. The ski sharpening arrangement of claim 10, wherein the one end of the support shaft is provided with an indicator plate to indicate the angle of the plane of abrasion relative to the base of the ski.

12. The ski sharpening arrangement of claim 11, wherein the movable adjustment device includes a front wall having a lower circular opening, an upper slotted opening and a pointed indicator.

13. The ski sharpening arrangement of claim 12, wherein a lower fastener is passed through the lower circular opening and is partially threaded into the support shaft, and an upper fastener is passed through the upper slotted opening and threaded into the support shaft, whereby selective manipulation of the upper and lower fasteners enables a tilting of the adjustment device relative to the support shaft, and causes an angular adjustment of the abrasive surface of the belt relative to the base of the ski.

14. The ski sharpening arrangement of claim 5, wherein the adjustment device is located adjacent the mounting framework of the powered grinder and above the side edge of the ski.

15. The ski sharpening arrangement of claim 8, wherein the O-rings on guide roller are maintained against the base of the ski by applying a force on the handle in a direction transverse to a rotational axis of the guide roller.

16. The ski sharpening arrangement of claim 13, wherein the indicator on the front wall of the adjustment device is movable relative to the indicator plate on the sleeve when the adjustment device is tilted relative to the support shaft.

17. A ski side edge sharpening arrangement for sharpening a ski having a top surface, a base, a pair of side edges and a bottom edge coplanar with the base, comprising:

a portable, powered grinder adapted to be manipulated by one hand of a user and including a motor assembly for driving an abrasive surface having a substantially flat plane of abrasion, wherein the abrasive surface is rotatable about an axis generally perpendicular to the base of the ski and is constantly engageable with the side edge of the ski to provide sharpening thereof; and a support structure suspended from the powered grinder and adapted to be manipulated by another hand of the user for constantly guiding the abrasive surface along the side edge of the ski along an entire length thereof, the support structure comprising:

a roller assembly having a guide roller engageable against the base of the ski and a fixed support shaft about which the guide roller rotates, and an adjustment device fixed to the powered grinder, the adjustment device being tiltably mounted relative to the support shaft such that the adjustment device is adjustable to control the angle of the plane of abrasion relative to the base of the ski.

* * * * *